United States Patent [19]

Hurst

[11] 4,094,407

[45] June 13, 1978

[54] NONPANELLING PLASTIC OIL CONTAINER

[75] Inventor: Jack Hurst, Houston, Tex.

[73] Assignee: Gulf Oil Corporation, Pittsburgh, Pa.

[21] Appl. No.: 765,502

[22] Filed: Feb. 4, 1977

[51] Int. Cl.[2] ..... B65D 81/00

[52] U.S. Cl. ..... 206/524.3; 206/524.4; 206/524.6; 260/42.45; 260/42.46; 260/45.75 F

[58] Field of Search ..... 260/42.45, 42.46, 45.75 F; 206/524.1, 524.4, 524.6, 524.3

[56] References Cited

U.S. PATENT DOCUMENTS 3,784,661 1/1974 Schaul ..... 260/42.46

*Primary Examiner*—James H. Derrington
*Attorney, Agent, or Firm*—Richard L. Kelly

[57] ABSTRACT

A filled, plastic container of hydrocarbon lubricating oil having a reduced tendency to panel is provided by fabricating a widemouth cylindrical container from an ethylene polymer having a density of at least about 0.950 g/ml. A concentration of about 10-1,000 ppm of carbon black is incorporated into at least the inner surface of the container. A concentration of at least about 1.0 weight % $TiO_2$ is included throughout the body of the container.

3 Claims, 4 Drawing Figures

FIG. 1
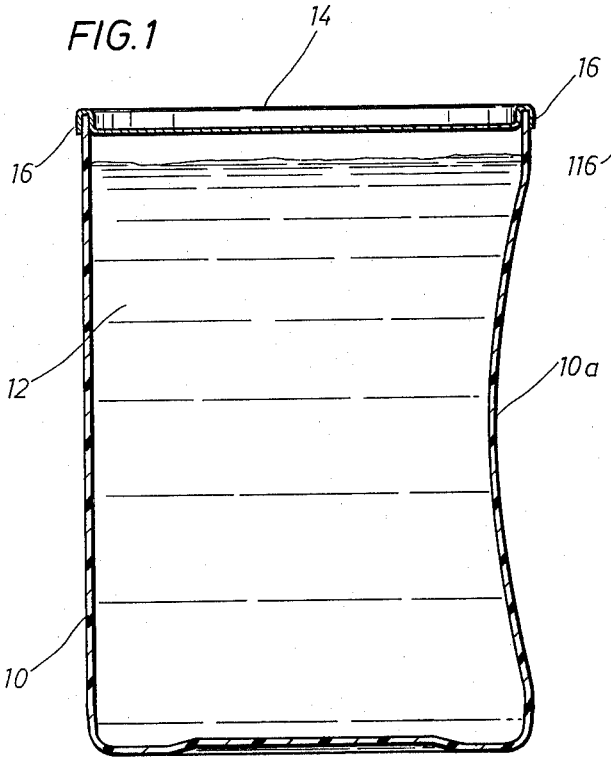
FIG. 2
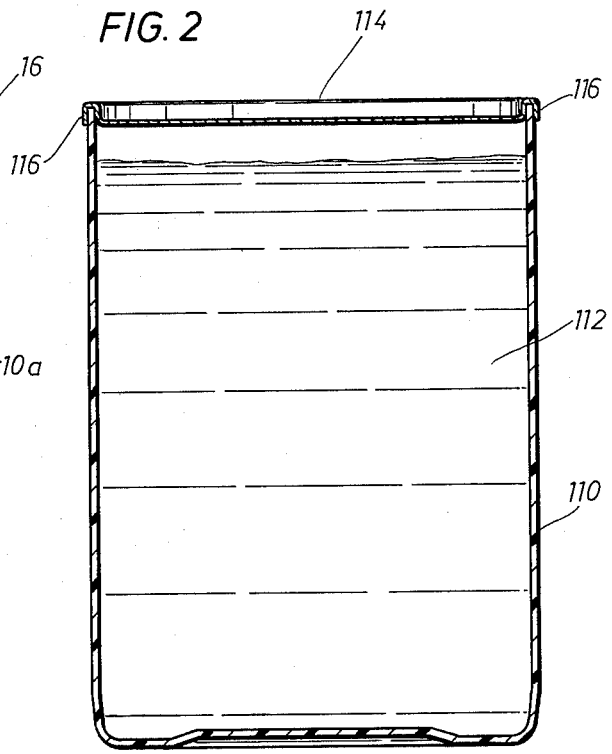
FIG. 3
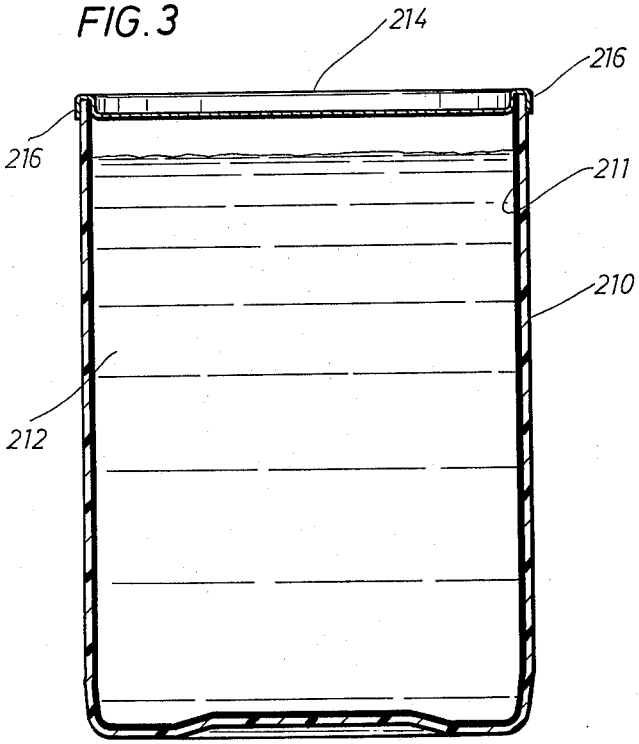
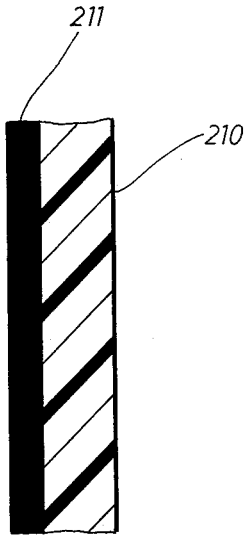
FIG. 3A

NONPANELLING PLASTIC OIL CONTAINER

BACKGROUND OF THE INVENTION

Manufacturers and marketers of hydrocarbon lubricating oils are packaging increasingly larger percentages of their hydrocarbon lubricating oils in widemouth cylindrical containers fabricated from high density ethylene polymers. This shift in packaging of such hydrocarbon lubricating oils has resulted from the fact that such plastic containers can be fabricated at significantly lower cost than the metal containers previously used for this purpose. One of the shortcomings associated with the use of such plastic containers is that the filled containers, particularly when exposed to sunlight over extended periods of time, frequently will develop inwardly-directed bulges. This phenomenon has been characterized in the art as "panelling."

SUMMARY OF THE INVENTION

The applicant has significantly reduced the problem of panelling associated with filled plastic containers of hydrocarbon lubricating oils by incorporating about 10–1,000 ppm of carbon black in at least the inner wall of the plastic container which comes in contact with a hydrocarbon lubricating oil.

DESCRIPTION OF THE DRAWINGS

FIG. 1 is a sectional view of a sealed prior art plastic oil container which has panelled.

FIG. 2 is a sectional view of a sealed plastic oil container of the invention which has not panelled.

FIG. 3 is a sectional view of another embodiment of the invention.

FIG. 3*a* is an enlarged view of a section of the wall of the container of FIG. 3.

DETAILED DESCRIPTION OF THE INVENTION

FIG. 1 illustrates a typical filled prior art plastic container of hydrocarbon lubricating oil which has panelled. The body of the container is a wide-mouth cylindrical container 10 fabricated from a high density ethylene polymer having a density of about 0.96 and which contains approximately 2 wt. % $TiO_2$. The container is filled with hydrocarbon lubricating oil 12 and is sealed by a metal lid 14 which is sealed by crimping as illustrated at 16. Upon exposure to sunlight over a period of time, an inwardly-directed bulge will form in the container as illustrated at 10*a*.

FIG. 2 illustrates an embodiment of the invention in which the container 110 is fabricated from the same high density ethylene polymer employed in the fabrication of the container illustrated in FIG. 1. The ethylene polymer in container 110 contains approximately 2 wt. % $TiO_2$ and approximately 100 ppm of carbon black. The hydrocarbon lubricating oil 112 in the container FIG. 2 is identical to the hydrocarbon lubricating oil 12 illustrated in FIG. 1. The mouth of container 110 is sealed by metal lid 114 which is crimped onto the mouth container 110 as illustrated at 116.

FIG. 3 illustrates another embodiment of the invention in which the plastic container has a laminated structure in which the main body of the container 210 is fabricated from a high density ethylene polymer containing about 2 wt. % $TiO_2$. The inner surface 211 of the container 210 is fabricated from the same high density ethylene polymer contained in body 210 and differs therefrom only in also containing about 100 ppm of carbon black. The mouth of the container is sealed with a metal lid 214 and is crimped onto the mouth of the container as illustrated at 216. Again, the container is filled with a hydrocarbon lubricating oil 212.

FIG. 3*a* is an enlarged view of the wall of the container of FIG. 3 and illustrates more clearly the laminated structure of the container.

From the foregoing descriptions, it will be noted that the sealed plastic oil container of the invention is similar to presently-employed sealed plastic oil containers in all respects, except that the applicant includes in at least the inner wall of the container from about 10 to 1,000 ppm of carbon black. Surprisingly, this small concentration of carbon black in the inner surface of the container wall virtually eliminates the problem of panelling when the filled, sealed containers are exposed to strong sunlight.

The plastic containers of the invention will be fabricated from an ethylene polymer having a density of at least about 0.95 gms/ml and preferably at least about 0.956 gms/ml. Ethylene polymers of this density are commercially available. The carbon black is incorporated into the ethylene polymer at a concentration of about 10 to about 1,000 ppm and preferably about 50 to about 500 ppm; these concentrations being expressed on a weight basis. Any of the commercial grades of carbon black can be used in the invention. $TiO_2$ also will be included in the ethylene polymer at a concentration of about 0.5 – 2.0 wt. % and p referably about 1.0 – 2.0 wt. %. $TiO_2$ is included in the ethylene polymer as it protects the polymer from oxidative degradation upon exposure to sunlight. Additional additives such as antioxidants, stabilizers, colorants and the like also can be incorporated into the ethylene polymer.

The wide-mouth containers of the invention can be fabricated by the same method employed to prepare the corresponding prior art containers. Such containers can be prepared by either thermoforming or blow molding techniques.

While the applicant does not wish to be bound by any explanation as to the reasons for his invention solving the previous prior art panelling problem, he will set forth his present belief as to the phenomenon which takes place. While high density ethylene polymers are frequently characterized as crystalline polymers, it is recognized that such polymers do contain a significant portion of amorphous polymer. A typical high density ethylene polymer having a density of about 0.96 will have about 70 weight % of the polymer in the crystalline state with the remaining 30 weight % of the polymer being in an amorphous state. It is believed that, when a plastic container fabricated from such a polymer is filled with hydrocarbon lubricating oil, the hydrocarbon oil in the container is partially absorbed by the amorphous polymer in the container wall. In some manner not fully understood, the absorption of oil into the container wall probably gives rise to the panelling, an effect much aggravated by exposure to sunlight.

In the containers provided by the invention, it is believed that the low concentration of carbon black incorporated into the ethylene polymer is preferentially incorporated into the amorphous component of the ethylene polymer. The amorphous polymer containing carbon black possibly does not absorb hydrocarbon lubricating oil to the same degree as does the amorphous component of a like ethylene polymer containing no carbon black. It is also possible that the amorphous polymer containing the carbon black prevents panelling of the wall of the container by some other mechanism.

For most purposes it is desirable to disperse the carbon black throughout the entire wall of the plastic container. The sole drawback to uniformly distributing the carbon black throughout the container wall is that the presence of the carbon black will impart a light gray color to the container. It is specifically noted that the $TiO_2$ pigment largely masks the strong tintorial effect of the carbon black.

In those instances in which the user of the container desires an intense white color in the finished container, it is possible to fabricate the container so that the carbon black is contained only in the inner wall of the container. The inclusion of the carbon black only in the inner wall is sufficient to prevent panelling, as the panelling appears to result from an interaction between the hydrocarbon lubricating oil and the inner wall of the container. No difficulty is encountered in fabricating such container, as illustrated in FIG. 3.

EXAMPLE

A batch of wide-mouth cylindrical containers having a one-quart capacity was blow molded from a resin composition consisting of an ethylene polymer having a density of 0.956 gms/ml and having incorporated therein 250 ppm of carbon black and 2.0 wt. % pigment grade $TiO_2$. As a control, a batch of identical containers were blow molded from an ethylene polymer composition of identical composition except that the carbon black was omitted therefrom.

The containers of the invention and the control containers were each filled with commercial grade SAE 20 lubricating oil and the containers were sealed with a metal lid. The containers were then stored, exposed to continuous sunlight at a Houston location for 30 days in the months of June and July. At the end of the tests, each of the sealed containers was examined and all of the prior art containers had panelled, whereas none of the containers of the invention had panelled.

I claim:

1. A filled plastic container of hydrocarbon lubricating oil having a reduced tendency to panel which consists essentially of:

(a) a wide mouth cylindrical container fabricated from an ethylene polymer having a density of at least about 0.950 gms/ml in which at least the inner surface of the container contains about 10 – 1,000 ppm of carbon black and the entire body of the container contains at least about 1.0 wt. % of $TiO_2$ pigment, (b) a liquid hydrocarbon lubricant which substantially fills the container, and (c) a cap affixed to and sealing the container.

2. The filled container of claim 1 in which the container has a laminated structure in which;

(a) the outer lamina is fabricated from an ethylene polymer having a density of at least 0.950 gms/ml and containing at least about 1.0 weight % of $TiO_2$ pigment; and (b) the inner lamina is fabricated from an ethylene polymer having a density of at least 0.950 gms/ml and containing at least about 1.0 weight % of $TiO_2$ pigment and about 10 – 1,000 ppm of carbon black.

3. A wide-mouth cylindrical container useful for packaging hydrocarbon lubricating oils and which is substantially free of panelling; said container being fabricated from an ethylene polymer having a density of at least 0.950 gms/ml, said ethylene polymer containing at least 1.0 wt. % of $TiO_2$ and 10 – 1,000 ppm of carbon black.

* * * * *